United States Patent [19]

Kanne

[11] 4,205,845

[45] Jun. 3, 1980

[54] GOLF CLUB SHAFT WITH ANGLED STEPS

[75] Inventor: John T. Kanne, Ashtabula, Ohio

[73] Assignee: True Temper Corporation, Cleveland, Ohio

[21] Appl. No.: 888,246

[22] Filed: Mar. 20, 1978

[51] Int. Cl.[2] ..... A63B 53/12

[52] U.S. Cl. ..... 273/80 B

[58] Field of Search ..... 273/77 R, 80 R, 80 B, 273/80.9; 280/11.37 B, 11.37 L

[56] References Cited

U.S. PATENT DOCUMENTS

| | | | |
|---|---|---|---|
| 2,007,970 | 7/1935 | Hartley | 273/80.9 |
| 2,037,636 | 4/1936 | Lagerblade | 273/80 B |

FOREIGN PATENT DOCUMENTS

| | | | |
|---|---|---|---|
| 9625 | of 1914 | United Kingdom | 273/80 B |
| 373930 | 6/1932 | United Kingdom | 273/80 R |
| 385241 | 12/1932 | United Kingdom | 273/80 R |
| 471020 | 8/1937 | United Kingdom | 273/80 B |

*Primary Examiner*—Richard J. Apley

*Attorney, Agent, or Firm*—Squire, Sanders & Dempsey

[57] ABSTRACT

A shaft for a golf club having steps angled obliquely relative to the axis of the shaft.

8 Claims, 4 Drawing Figures

GOLF CLUB SHAFT WITH ANGLED STEPS

The present invention relates to flexible shafts, and in particular to shafts for golf clubs.

Various attempts have been made over the years to both enhance and control the flexibility of golf club shafts to enable the golfer to better control shots with the club. Furthermore, since the development of tubular golf shafts, coupled with the foregoing design objectives have been the goals of reducing the amount of metal used in the shaft and of improving the appearance of the shaft. Early tubular metal shafts were uniformly tapered inwardly toward the axis of the shaft from a maximum outer diameter at the upper or handle end portion of the shaft to a minimum outer diameter at the juncture of the shaft and the golf club head. A shaft comprising a plurality of integrally joined substantially cylindrical tempered steel sections disposed in stepped relation is disclosed in U.S. Pat. No. 1,670,531, wherein the rate of change of diameter of the shaft may be varied along the shaft to control the flexure of the shaft along its length. U.S. Pat. No. 2,146,048 discloses a hollow metal golf club shaft configured and having thickened wall portions for controlling the flexure and direction of vibration in the shaft. Various other golf club shafts are known comprising steps generally defined by planes perpendicular to the axis of the shaft.

Other tubular golf club shafts are known which are tapered inwardly toward the axis of the shaft from a wide handle to a narrow neck adjacent the club head. For example, U.S. Pat. Nos. 1,929,415, 2,007,970, 2,008,077, and 2,008,423 show tubular golf shafts fabricated from spirally wound metal strip. Design Pat. No. 118,594 shows a tubular golf club shaft whose cross section is circular at the opposite end portions and whose intermediate portion has a ridge running lengthwise along the shaft.

Despite the variety of constructions of golf club shafts known in the art, golf club shafts have heretofore been unknown which comprise steps angled obliquely to the central or longitudinal axis of the shaft.

It is an object of the present inventin to provide an improved golf club shaft having a novel stepped construction for controlling the direction and amount of flexure in the club.

Another object of the invention is to provide a tubular metal golf club shaft having a novel stepped construction of improved appearance.

Other objects will be apparent from the description to follow and from the appended claims.

According to the preferred embodiments of the invention described below, golf club shaft constructions are provided which include steps oriented obliquely to the central axis of the shaft. Such shafts comprise steps oriented obliquely to the axis of the shaft, and can include a combination of a variety of such steps or a combination thereof with otherwise oriented steps such as steps oriented perpendicularly to the shaft axis.

Referring to the drawings.

Figures 1, 2, 3, 4:
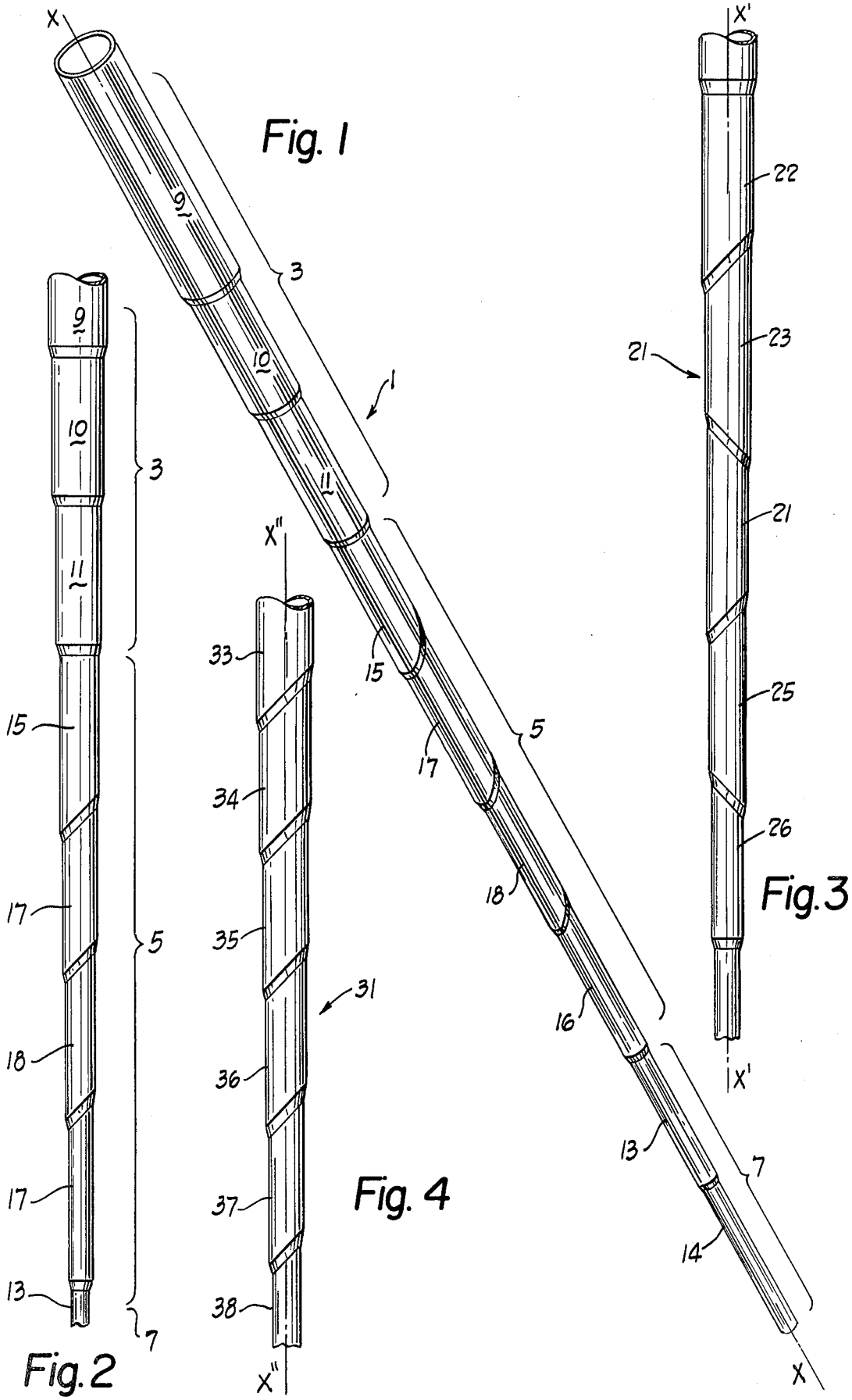
FIG. 1 is a perspective view of a preferred embodiment of a golf club shaft according to the invention.
FIG. 2 is a side elevation of the shaft shown in FIG. 1.
FIG. 3 is a side elevation of another embodiment of the invention.
FIG. 4 is a side elevation of a further embodiment of the invention.

Turning to FIGS. 1 and 2, a tubular metal golf club shaft 1 is shown having a central axis x, and three sets of steps 3,5 and 7. The set of steps identified by the numeral 3 comprises juxtaposed, generally cylindrical hollow steps 9–11, and set 7 comprises a similar set of portions 13–14. Step 9 either forms part of or is closest to the handle of the club and step 14 is located closest to the head of the club. Steps 9–11 and 13–14 are substantially perpendicular to axis x of shaft 1, in that their end portions are defined by planes substantially perpendicular to axis x. The intermediate set of steps 5 comprises steps oriented obliquely to axis x; thus steps 15 and 16 are generally defined at their lower and upper ends, respectively, by planes oblique to axis x. Steps 17 and 18 are adjacent to steps 15 and 16 respectively, and are defined by similarly oblique planes separating steps 17 and 18 from each other and from adjacent steps 15 and 16. Shaft 1 is tapered inwardly from the uppermost portion to the lowermost portion, and accordingly the outer cross sectional dimension perpendicular to axis x of the respective steps decreases from a maximum value for section 9 to a minimum value for step 14. The cross sections of the respective steps 9–18 are circular except at their angled ends, and thus the variation in the cross sectional dimensions referred to above are essentially variations in the outer diameter of the steps of the shaft.

Whereas shaft 1 of FIGS. 1 and 2 is composed of a combination of oblique and perpendicular steps, the embodiment of the invention shown in FIG. 3 is a shaft 21 comprising a variety of oblique steps. Shaft 21 has a longitudinal axis x′, and a plurality of steps 22–26 which are referred to as being oblique because their ends are defined by planes oblique to axis x′. Steps 23–25 in FIG. 3 are respectively defined by end planes not only oblique to axis x′ but also oblique to each other, as contrasted with steps 17–18 in FIGS. 1 and 2 which are respectively defined by parallel end planes. Steps 22 and 26 are similar to steps 15 and 16 in that each is defined at one end by a plane oblique to the shaft axis and at the opposite end by a plane perpendicular to the shaft axis. (For the purpose of this description, a step is referred to as "oblique" or "angled obliquely" to the axis of the shaft if one or both ends is so inclined relative to the shaft axis).

Another embodiment of the invention is shown in FIG. 4, wherein a golf club shaft 31 comprises a plurality of steps 33–38 which are defined at their ends by parellel planes oblique to longitudinal axis x″ of shaft 31. The respective steps are circular in cross section except at their end portions, and the respective diameters of steps 33–38 decrease in sequence from the handle portion to the lowermost step 38 closest to the golf club head.

Although the steps of the golf club shaft described herein are stated as being defined by planes, it is intended that the surfaces of given steps can be non-planar but that such surfaces are generally distributed about an oblique plane which is the locus of those surfaces. Also, adjacent steps need not be in abutting relationship, but can be separated by tapered shoulders as shown.

The oblique steps incorporated in shafts according to the invention make available to the gold club designer an endless variety of shafts whose flexibility and appearance are determined in part by the nature of the steps. Thus, the angles of the respective end portions of the respective shafts can regulate the magnitude of the flexibility of the shaft and variations in such magnitude according to direction. By the expedient of angling the respective steps, the stiffness or flexibility of golf club shafts can be varied to alter the characteristics of shafts of given lengths and diameters. By this same expedient the aesthetics of the shafts can be varied as well.

Thus, whereas prior stepped shafts were composed of perpendicular steps defined by planes perpendicular to the longitudinal axis of the shaft, rendering the appearance and flexibility of a step of given length and wall thickness essentially invariable; obliquely stepped shafts according to the present invention provide for variation in the appearance and flexibility characteristics of such steps of given length by controlling the angle of the steps. Furthermore, such control is rendered even more variable for a full golf shaft since the angle of the steps can be varied relative to each other and relative to the golf club head, a feature not available in conventional stepped shafts.

The invention has been described in detail with reference to the preferred embodiments thereof, but it will be understood that variations and modifications within the spirit and scope of the invention may occur to those skilled in the art to which the invention pertains.

I claim:

1. A golf club shaft having a longitudinal axis comprising a plurality of juxtaposed elongated steps; each of said steps including a medial portion, having a substantially circular cross-section, and being bounded at either end by tapered shoulders at the junctures between adjacent steps; the locus of points along the edge between any given step and its respective shoulder defining a plane; wherein at least one of said planes oblique to said longitudinal axis.

2. The golf club shaft of claim 1, wherein each of said steps is tubular metal step.

3. The golf club shaft of claim 1, wherein at least one of said planes is perpendicular to said longitudinal axis.

4. The golf club shaft of claim 1, wherein at least one step is bounded by opposing shoulders defining planes which are oblique to both said longitudinal axis and each other.

5. The golf club shaft of claim 3, wherein said at least one perpendicular plane is disposed at one end of a step which terminates at its other end in a tapered shoulder also defining a perpendicular plane.

6. The golf club shaft of claims 1, 2, 3, 4, or 5, wherein said shaft is a tapered shaft.

7. The golf club shaft of claim 6, wherein the circular cross-section of each step is substantially uniform throughout the medial portion thereof.

8. The golf club shaft of claim 7, wherein the diameter of the cross-section for each step decreases incrementally from the uppermost to the lowermost step comprising the shaft.

* * * * *

UNITED STATES PATENT AND TRADEMARK OFFICE

CERTIFICATE OF CORRECTION

PATENT NO. : 4,205,845

DATED : June 3, 1980

INVENTOR(S) : John T. Kanne

It is certified that error appears in the above-identified patent and that said Letters Patent are hereby corrected as shown below:

In column 1, line 43, correct the spelling of -- invention --.

In column 2, line 63, correct the spelling of -- golf --.

In claim 1, at column 4, line 4, insert -- is -- between "planes" and "oblique".

In claim 2, at column 4, line 7, insert -- a -- between "is" and "tubular".

Signed and Sealed this

*Twenty-third* Day of *September 1980*

[SEAL]

*Attest:*

*Attesting Officer*

SIDNEY A. DIAMOND

*Commissioner of Patents and Trademarks*